US008257009B2

(12) United States Patent
Geraghty

(10) Patent No.: US 8,257,009 B2
(45) Date of Patent: Sep. 4, 2012

(54) DIPPER STICK WITH IMPLEMENT COUPLING MEANS

(75) Inventor: William F. Geraghty, Cumberland, MD (US)

(73) Assignee: Rockland, Inc., Bedford, PA (US)

( * ) Notice: Subject to any disclaimer, the term of this patent is extended or adjusted under 35 U.S.C. 154(b) by 146 days.

(21) Appl. No.: 12/422,702

(22) Filed: Apr. 13, 2009
(Under 37 CFR 1.47)

(65) Prior Publication Data

US 2011/0033273 A1 Feb. 10, 2011

(51) Int. Cl.
*E02F 3/36* (2006.01)

(52) U.S. Cl. ..... 414/723; 37/468; 403/321

(58) Field of Classification Search ..... 414/723; 37/468; 403/321
See application file for complete search history.

(56) References Cited

U.S. PATENT DOCUMENTS 6,058,633 A * 5/2000 Barden ..... 37/468
6,718,663 B1 * 4/2004 Geraghty ..... 37/468
2004/0076504 A1 * 4/2004 Geraghty ..... 414/723

* cited by examiner

*Primary Examiner* — Donald Underwood
(74) *Attorney, Agent, or Firm* — Novak Druce + Quigg LLP

(57) ABSTRACT

An assembly for detachably connecting an implement having a pair of mounting pins to a machine provided with a dipper stick and a pair of tilt links operatively connected to the dipper stick, comprising a first assembly including a pair of jaw members pivotally connected to the dipper stick and cooperable upon pivotal movement thereof to selectively grip and release one of the mounting pins, and means for selectively pivoting the jaw members in opposite directions to effect such grip and release of the one of the mounting pins; and second and third assemblies each including a pair of jaw members pivotally connected to one of the tilt links and cooperable upon pivotal movement thereof to selectively grip and release the other of the mounting pins, and means for selectively pivoting the jaw members in opposite directions to effect such grip and release of the other of the mounting pins.

5 Claims, 6 Drawing Sheets

DIPPER STICK WITH IMPLEMENT COUPLING MEANS

This invention relates to assemblies mountable on machines having front end assemblies including a dipper stick and tilt links for detachably coupling various implements thereto.

BACKGROUND OF THE INVENTION

In various industries including the construction, mining, land clearing and other industries, in an effort to improve productivity, it has been the practice to use various types of couplers for detachably mounting a number of different implements on machines for performing different work functions. Typically, such couplers have consisted of devices mountable on the dipper stick and tilt links of the machine, and connectable to mounting pins provided on the implements. They normally are large, bulky and heavy, unduly adding excess weight to the front end of the machine and correspondingly decreasing the payload and productivity of the machine. Accordingly, it is the principal object of this invention to provide an improved coupling arrangement for machines equipped with a dipper stick and tilt links which is simple in design, comparatively inexpensive to manufacture, relatively easily to install and operate and comparatively lightweight. It is a further object of the invention to provide such an arrangement which may be retrofitted on machines having conventional dipper sticks and tilt links.

SUMMARY OF THE INVENTION

The aforementioned and other objects of the present invention are achieved by providing a first assembly including a pair for jaw members pivotally connected to a dipper stick and cooperable upon pivotal movement thereof to selectively grip and release one of the mounting pins of an implement, and means for selectively pivoting such jaw members in opposite directions to effect such grip and release of such mounting pin; and second and third assemblies each including a pair of jaw members pivotally connected to one of the tilt links of the machine and cooperable upon pivotal movement thereof to selectively grip and release the other of the mounting pins of the implement, and means for selectively pivoting the jaw members in opposite directions to effect such grip and release of the other of the mounting pins. In one embodiment of the invention, in each of such assemblies, a fluid actuated cylinder assembly is used to provide a reciprocating action, and a suitable linkage is provided for translating the reciprocating, linear motion of the rod member of the cylinder assembly to pivotal motion of the jaw members to provide the gripping and releasing action. In another embodiment of the invention, a spring is provided for biasing the jaws in an open position and a caroming action is utilized to urge the jaws into a closed position. It further is contemplated that such assemblies may be produced as kits and/or complete assemblies and retrofitted on machines having commercially available dipper sticks and tilt links.

DETAILED DESCRIPTION OF AN EMBODIMENT OF THE INVENTION

Figure 3:
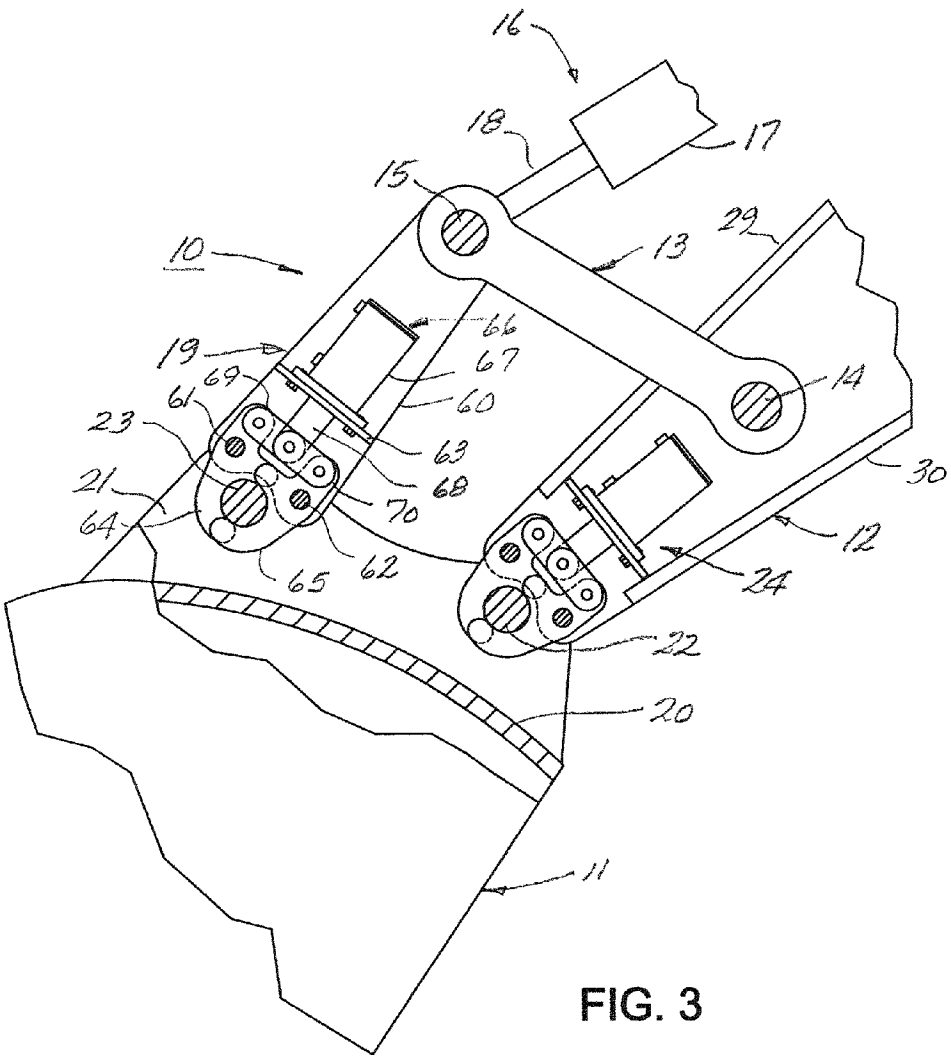
FIG. 3 is a side elevational view of a portion of a front end assembly of a machine having an implement coupled thereto by assemblies embodying the present invention.

Referring to FIG. 3 of the drawings, there is partially illustrated a front end assembly 10 of a machine and an implement 11 detachably connected to such front end assembly. The machine is of a conventional construction including a main frame supported crawler or wheel units, an upper frame and cab mounted on the support frame and possibly rotatable thereon, a boom mounted on the main or upper frame, a fluid actuated cylinder assembly operatively interconnecting such boom and a frame of the machine for raising and lowering it and front end assembly 10 operatively connected to the boom. The front end assembly is operatively connected to the boom end and includes a dipper stick 12 pivotally connected at an end thereof to the free end of the boom, a fluid actuated cylinder assembly operatively interconnecting the dipper stick and boom for pivotally displacing the dipper stick relative to the boom, a pair of support links 13, 13 pivotally connected at one set of ends to a connecting pin 14 mounted transversely in the dipper stick adjacent an end thereof, and connected at an opposite set of ends thereof by a connecting pin 15, a fluid actuated cylinder assembly 16 having a cylinder member 17 pivotally connected at a base end thereof to brackets mounted on the upper side of the dipper stick, and a rod member 18 pivotally connected to connecting pin 15, operable to pivot the support links relative to the dipper, and a pair of tilt links 19, 19.

Implement 11 may consist of any type of implement normally detachably connected to a machine of the type described for performing various work functions such as a bucket, rake, grapple and the like. The implement illustrated is an excavating bucket having an upper, rear wall 20 provided with a pair of transversely spaced mounting brackets 21, 21. Provided on mounting brackets 21, 21 is a set of spaced, transversely disposed mounting pins 22 and 23 which are adapted to be engaged by a coupling assembly 24 mounted in the end of dipper stick 12 and tilt links 19, 19, respectively, to detachably connect the bucket to the front end assembly of the machine.

Figure 1:
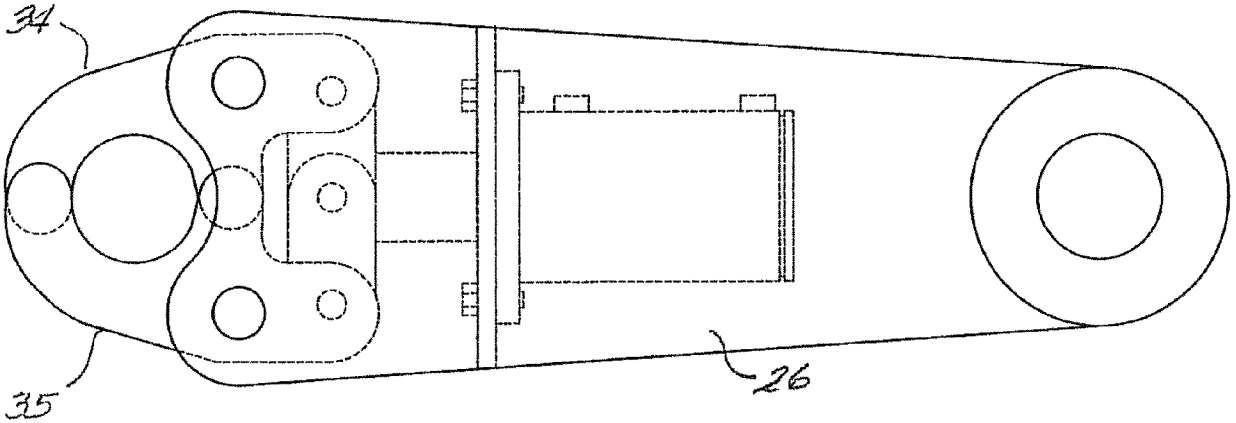
FIG. 1 is a side elevational view of a coupling assembly mounted on the front end of a dipper stick of a machine, consisting of a first embodiment of the present invention.
Figure 2:
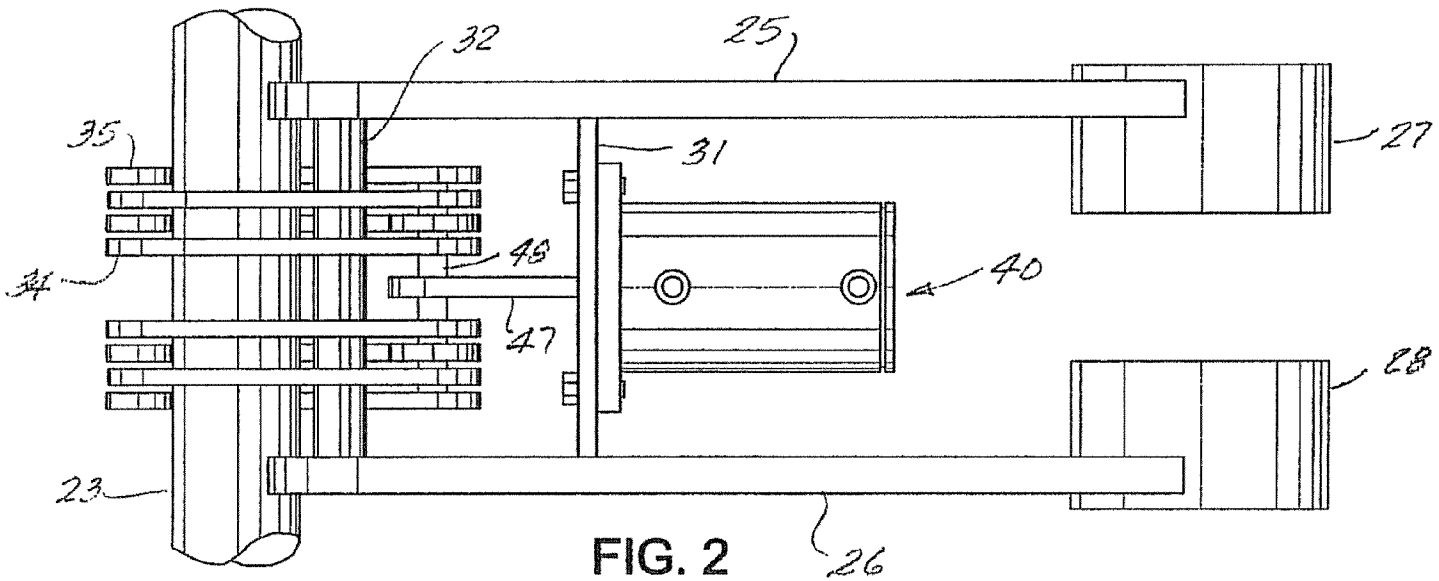
FIG. 2 is a top view of the assembly shown in FIG. 1 having an upper plate portion thereof removed.
Figure 4:
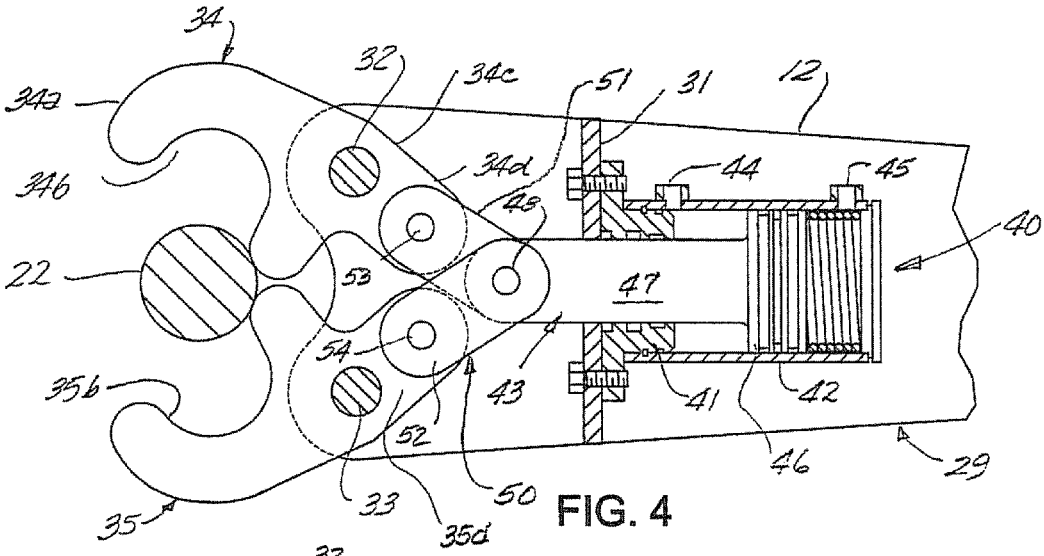
FIG. 4 is a vertical cross sectional view of the assembly shown in FIGS. 1 and 2, illustrating the jaw portions thereof in fully opened positions.
Figure 5:
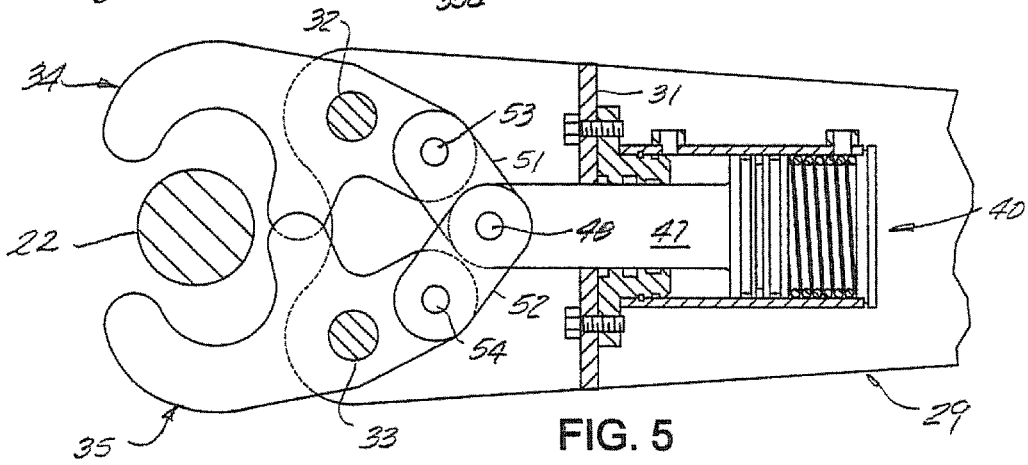
FIG. 5 is a view similar to the view shown in FIG. 4, illustrating the jaw members thereof in partially closed positions.
Figure 6:
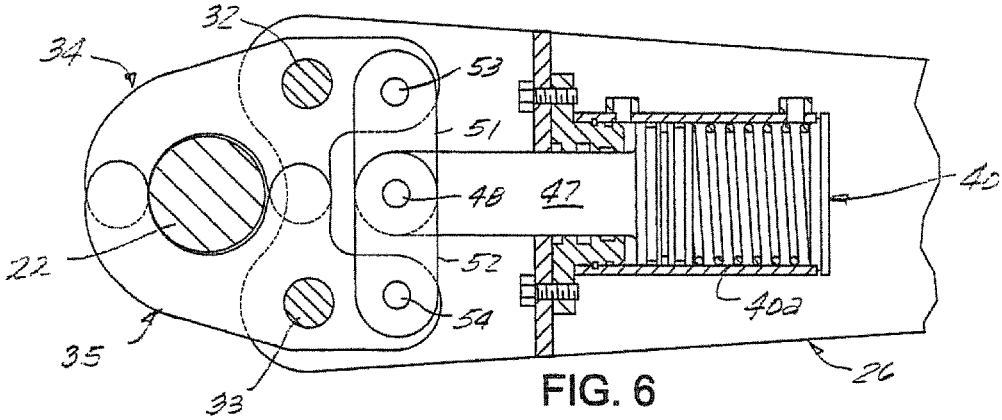
FIG. 6 is a view similar to the views shown in FIGS. 4 and 5, illustrating the jaws in their fully closed positions gripping a mounting pin.
Figure 7:
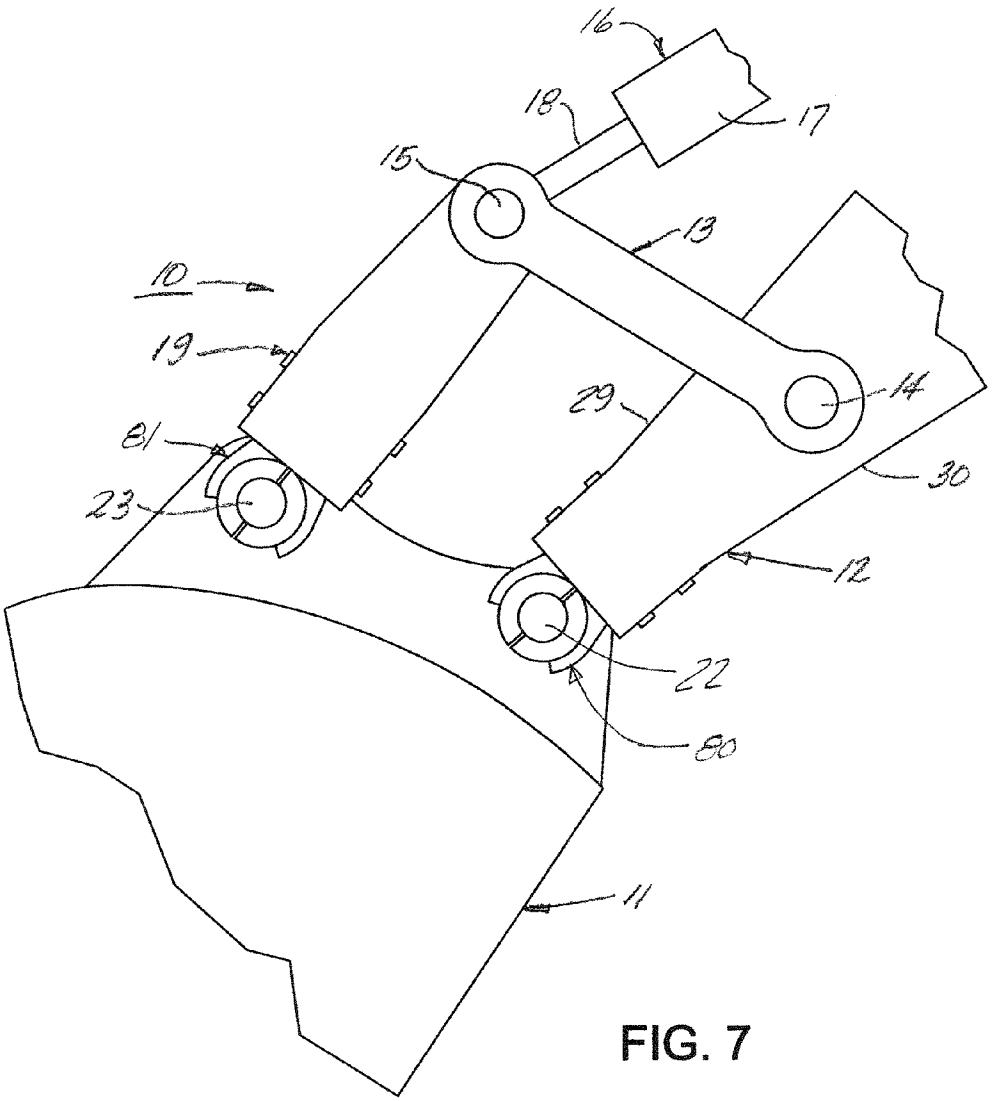
FIG. 7 is a side elevational view of a coupling assembly mounted on the front end of a dipper stick of a machine, consisting of another embodiment of the invention.

Referring to FIGS. 1 through 3, the free end of the dipper stick is formed with a pair of side walls 25 and 26 having a pair of bushings 27 and 28 in which connecting pin 14 is journaled, and upper and lower walls 29 and 30 providing a front open end, and a mounting plate 31 disposed transversely, spaced from the front open end of the dipper stick and rigidly secured to the side walls of the dipper stick. Disposed forwardly of support wall 31, adjacent the front open end of the dipper stick is a pair of transversely disposed pins 32 and 33 rigidly connected at their ends to the side walls of the dipper stick. As best seen in FIGS. 4 through 5, connecting pins 32 and 34 are equally spaced above and below a centerline of the dipper stick.

Mounted on pins 32 and 33 is a pair of jaw members 34 and 35. Upper jaw member 34 has a forwardly disposed portion 34*a* extending out of the open end of the dipper stick and including a recess 34*b* having an arcuate bottom surface which is adapted to receive mounting pin 22 of implement 11, an intermediate section 34*c* mounted on pin 32 and a rearwardly disposed portion 34*d* disposed within the dipper stick. Jaw member 35 has a substantially similar configuration but inverted 180° so that the recess 35*b* thereof is adapted to receive the lower side of mounting pin 22. Also mounted within the dipper stick along the centerline thereof is a fluid actuated cylinder assembly 40. Such assembly includes a mounting flange 41 mounted on an inner side of support wall 31, a cylinder member 42 and a rod member 43. The cylinder is mounted on and secured to an annular portion of mounting flange 41 and is provided with a pair of ports 44 and 45 connectable to a source of fluid under pressure through supply and return lines having suitable controls. Rod member 33 is provided with a head portion 46 within the cylinder member providing separate compartments each communicating with a port 44 or 45, and a shank portion 47 lying along the centerline of the dipper stick, extending through an opening in support wall 31 and having a connecting pin 48 mounted on the free end thereof. Cylinder assembly 40 operates in the conventional manner whereby upon supplying and withdrawing fluid from opposite ends of the cylinder member, the rod member will be caused to reciprocate linearly.

The linear motion of cylinder assembly 40 is translated to pivotal motion of jaw members 34 and 35 by means of an interconnecting linkage 50. Such linkage includes a pair of links 51 and 52. Link 51 is pivotally connected at one end thereof to the free end of rod member 47 by means of connecting pin 48 and is pivotally connected to rearwardly disposed portion 34*d* of jaw member 34 by means of a connecting pin 52. Similarly, link 52 is pivotally connected to the free end of rod member 47 by means of connecting pin 48 and the opposite end thereof is pivotally connected to the rearwardly disposed portion 35*d* of jaw member 35 by means of a connecting pin 54.

The coupling mechanism of each tilt link 19 is essentially the same as the coupling mechanism provided in the dipper stick. As best shown in FIG. 3, each tilt link 19 includes an elongated housing 60 having an opening at one end for receiving connecting pin 15, a pair of transversely disposed pins 61 and 62 positioned adjacent an opposite end thereof and spaced from a longitudinal centerline of the link, and a mounting wall 63 disposed transversely within housing 60 between the ends thereof. Pivotally mounted on pins 61 and 62 is a pair of jaw members 64 and 65 comparable to jaw members 34 and 35, respectively, operable to grip and release mounting pin 23. Mounted on wall member 63 is a fluid actuated cylinder assembly 66 comparable to fluid actuated cylinder assembly 40, including a cylinder member 67 mounted on wall member 63 and a rod member 68 extending through an opening in wall member 63 and displaceable along the longitudinal centerline of the link. The linear displacement of link member 68 is translated to pivotal movement of jaw members 64 and 65 by a pair of connecting links 69 and 70 comparable to connecting links 51 and 52, respectively, each of which is pivotally connected at one end thereof to rod member 68 and pivotally connected at an opposite end thereof to a jaw member 64 or 65. Such mechanism operates similarly to the mechanism described with respect to the dipper stick mechanism whereby upon extension and retraction of rod member 68, jaw members 64 and 65 will be caused to pivot and correspondingly grip and release mounting pin 23.

In the use of the coupling assembly as described to detachably couple implement 11 to dipper stick 12, the operator on the machine will operate certain controls to supply fluid under pressure to the rod ends of cylinder members 42 and 67 to cause the rod members thereof to retract and correspondingly open the different sets of jaw members in the coupling assemblies mounted on the end of the dipper stick and in the tilt links. Additional controls are then operated to position the coupling jaw members of the dipper stick in alignment with mounting pin 22 of the implement. With such jaw members thus positioned, controls are operated to apply fluid under pressure to the base end of cylinder member 42 to extend rod member 47 and correspondingly rotate jaw members 34 and 35 to grip mounting pin 22. Cylinder assembly 16 then is operated to position jaw members 64 and 65 of tilt links 19, 19 into alignment with mounting pin 23. Fluid under pressure then is supplied to the base ends of cylinder members 67, 67 to extend rod member 68, 68 and correspondingly close jaw members 64, 64 and 65, 65 to grip mounting pin 23. With mounting pins 22 and 23 thus gripped, implement 11 will be securely coupled to dipper stick 20 and tilt links 19, 19, permitting the dipper stick to be maneuvered to position the implement, and cylinder assembly 17 to be operated to cause the implement to be pivoted about the axis of mounting pin 22 in the conventional manner.

To assure positive coupling of the implement to the dipper stick of the machine as described, cylinder member 42 is provided with a compression spring 40*a* and each of cylinder members 67 is provided with a similar compression spring which function to bias the rod members thereof in their extended positions, and the associated jaw members in the closed positions positively gripping mounting pins 22 and 23 members thereof in their extended positions, and the associated jaw members in the closed positions positively gripping mounting pins 22 and 23.

Figure 8:
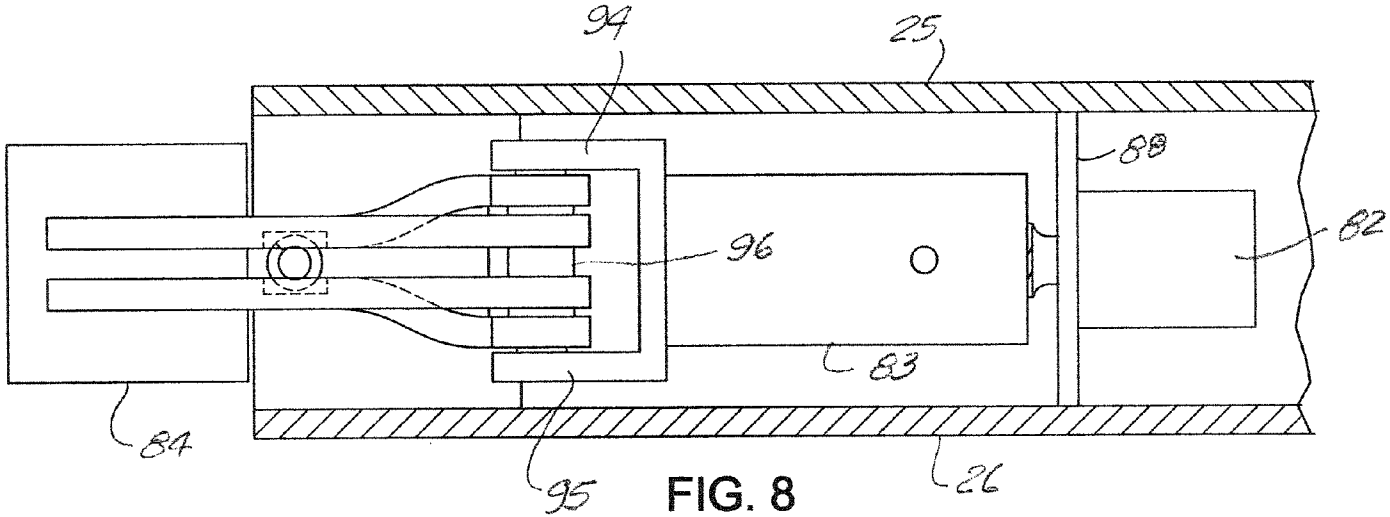
FIG. 8 is an enlarged, partial top view of the dipper stick shown in FIG. 7, having a portion of the upper wall thereof removed therefrom.
Figure 9:
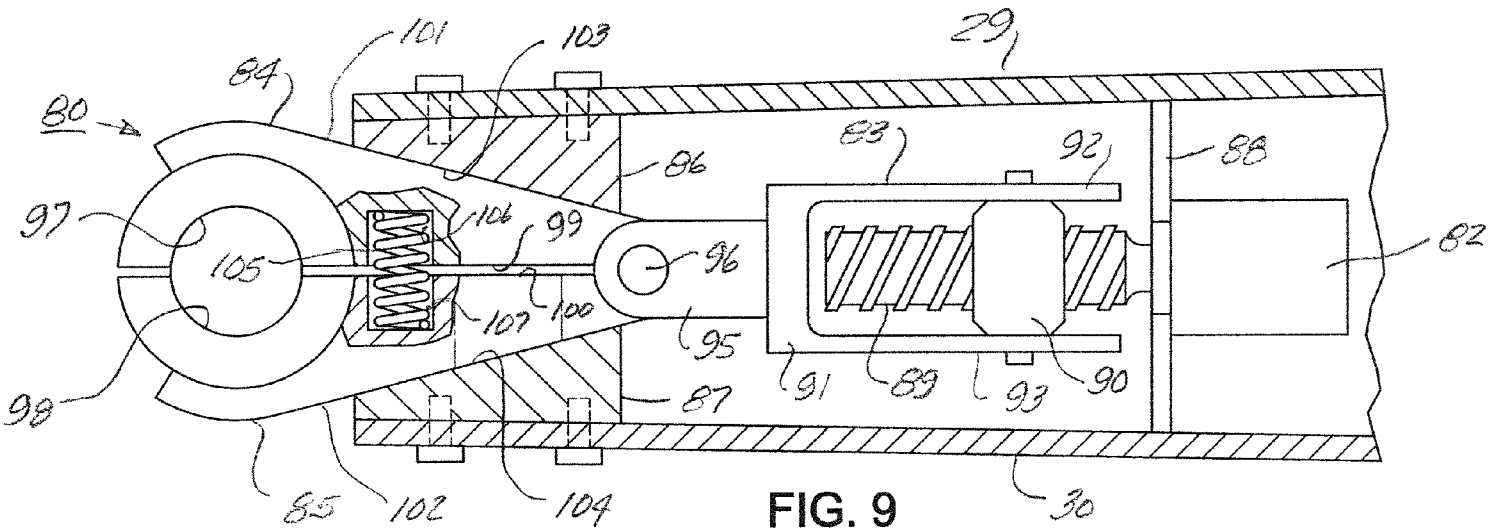
FIG. 9 is an enlarged, partial side elevational view of the dipper stick shown in FIG. 7, having a portion of the side wall thereof removed therefrom.

FIGS. 7 through 12 illustrate another embodiment of the invention. Such embodiment includes a coupling assembly 80 mountable in the free end of the dipper stick, comparable to coupling assembly 24, and a pair of coupling assemblies 81 mounted in the tilt links comparable to the coupling assemblies mounted in tilt links 19 of the previously described embodiment. As best shown in FIGS. 8 and 9, coupling assembly 80 includes a rotary actuator 82, a displaceable link 83, a pair of gripping jaws 84 and 85 and a pair of carnming blocks 86 and 87. Rotary actuator 82 is mounted on a transverse wall 88 rigidly connected to the walls of the dipper stick, along the centerline of the dipper stick. It includes a self-locking ball screw 89 which cooperates with a nut 90 carried by displaceable link 83. The displaceable link is provided with a base portion 91, a pair of rearwardly extending arm portions 92 and 93 on which nut 90 is mounted, and a pair of forwardly projecting arm portions 94 and 95 provided with a transversely disposed connecting pin 96. Gripping jaws 84 and 85 are disposed between caroming blocks 86 and 87 and are pivotally connected at the rear ends thereof to connecting pin 96. The opposite ends thereof project beyond the free end of the dipper stick and are provided with recesses 97 and 98 which cooperate to receive an implement mounting pin 22 in coupling an implement 11 to the dipper stick.

When the jaws are in a closed position as shown in FIG. 9, the jaws provide a pair of inner surfaces 99 and 100 which lie along the centerline of the dipper stick, and a pair of outer surfaces 101 and 102 which are disposed at acute angles relative to inner surfaces 99 and 100, respectively, and engage a pair of diverging cam surfaces 103 and 104 on cam blocks 86. Cam blocks 86 and 87 are rigidly secured to the upper and lower walls of the dipper stick adjacent the free end thereof and their caroming surfaces 103 and 104 are disposed at acute angles relative to the longitudinal centerline of the dipper stick. The jaws are biased apart into their open positions by means of a spring 105 disposed between the jaws and seated in recesses 106 and 107 formed in opposed inner surfaces 99 and 100.

Coupling assembly 80 operates in a manner whereby when rotary actuator 82 is operated, the cooperation of ball screw 89 and nut 90 will cause displaceable link 83 and correspondingly jaws 84 and 85 to be displaced along a line of travel substantially coexistent with the longitudinal centerline of the dipper stick. When the rotary actuator is driven in a first direction to displace the displaceable link outwardly, spring 105 will function to spread the jaws apart into an open position. When the actuator is driven in the opposite direction, displaceable link 83 will be retracted causing the jaw members in engagement with cam surfaces 103 and 104 to pivot together against the biasing action of spring 106 into a closed position.

Figure 10:
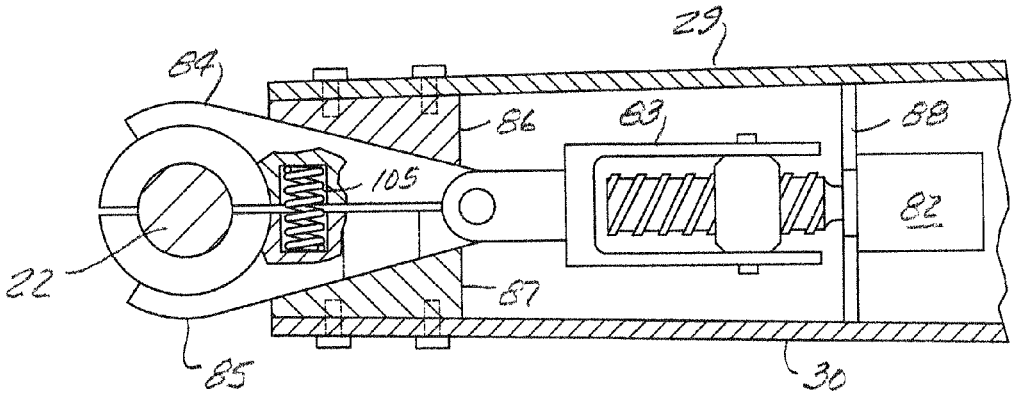
FIG. 10 is a view similar to the view similar to the view shown in FIG. 9, illustrating the jaws of the assembly fully gripping a mounting pin of an implement coupled to the front end assembly of a machine.
Figure 11:
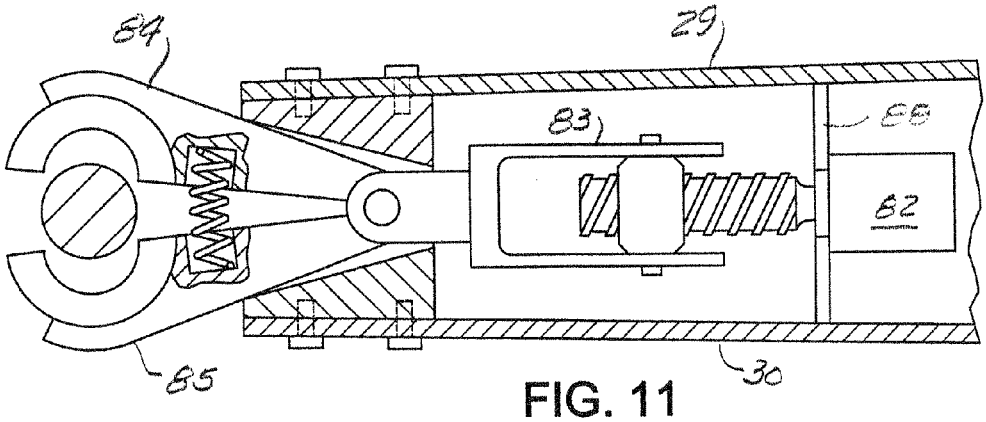
FIG. 11 is a view similar to the view shown in FIG. 10, illustrating the jaws of the assembly in a partially open position.
Figure 12:
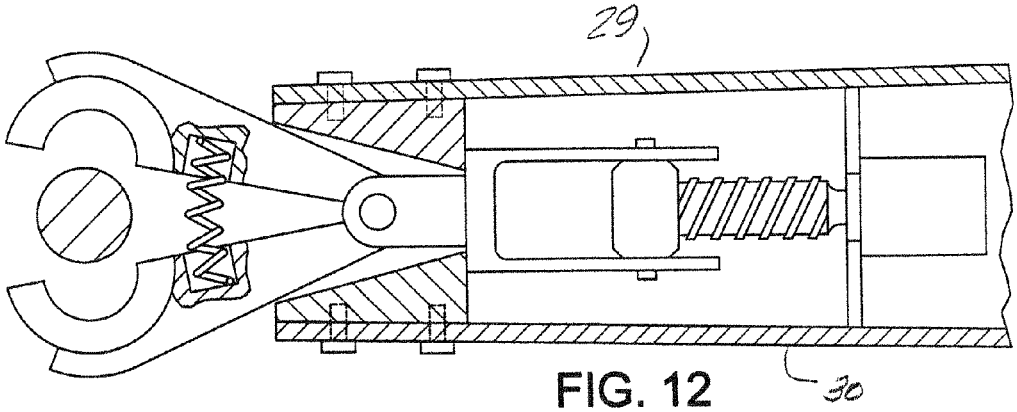
FIG. 12 is a view similar to the view shown in FIG. 10, illustrating the jaws of the assembly in a fully open position.

FIG. 10, similar to FIG. 9, illustrates displaceable link 83 in its most retracted position, causing the jaw members to engage caroming surfaces 103 and 104 and thus pivot together to a close position gripping an implement mounting pin 22. FIG. 11 illustrates the actuator having been operated to displace link 83 forwardly, thus causing the jaw to partially open under the biasing action of spring 105. FIG. 12 illustrates the actuator having operated further to displace link 83 to its maximum extended position thus causing the jaw to fully open under the biasing action of spring 105.

Coupling mechanisms 81 mounted in links 19 are comparable in construction and operation to coupling assembly 80. As in the previous embodiment, the coupling assemblies in the dipper stick and tilt links may be manipulated by maneuvering of the dipper stick and tilt links to position coupling assemblies 80 and 81 in position to grip the mounting pins of an implement to be coupled to the machine. The operation of the rotary actuators for coupling assemblies 80 and 81 is controlled by suitable controls provided at the operator's station in the cab of the machine. The rotary actuators may consist of hydraulic or electrical motors. In addition, fluid actuated cylinder assemblies may be utilized to displace the jaws along a line of travel substantially coinciding with the longitudinal centerlines of the dipper stick with respect to coupling assembly 80 and the centerlines of the tilt links with respect to coupler assemblies 81. In applications utilizing a fluid actuated cylinder for displacing the jaws and thus causing them to open and close, a pilot holding valve is utilized to assure the closure of the jaws and a secure coupling of the implement to the machine when the implement is in use.

In newly constructed front end assemblies of machines, the free end of the dipper stick may be provided with a suitable opening and coupler assembly 24 may be installed in such free end, and a pair of links 19 having coupling mechanisms therein as described, may simply be connected to connecting pin 15. In existing machines in which the coupling assembly may be retrofitted, the free end of the dipper stick may be provided with a suitable opening at the free end thereof to install a coupling assembly and the solid tilt links may be replaced with tilt links 19, 19 provided with coupling assemblies as described.

From the foregoing detailed description, it will be evident that there are a number of changes, adaptations and modifications of the present invention that come within the province of those having ordinary skill in the art to which the present invention pertains. However, it is intended that all such variations not departing from the spirit of the invention be considered as within the scope thereof as limited solely by the following claims.

I claim:

1. An assembly mountable on a component of a front end assembly of a machine, connectable to a mounting pin of an implement, comprising:

a pair of jaws mountable on said component, cooperable in gripping relation with said mounting pin, wherein one of said jaws is pivotally displaceable relative to the other of said jaws;

means mountable on said component for effecting a linear motion along a line of travel; and a motion translating linkage operatively interconnecting said linear motion effecting means and at least said pivotally displaceable jaw for converting said linear motion to pivotal motion of said pivotally displaceable jaw, wherein said linear motion effecting means includes a guide member mountable on said component, having an opening therethrough aligned with said line of travel, provided with a cam surface diverting from an alignment of said line of travel and having portions of said jaws extending therethrough, wherein the pivotal connection of said jaws is disposed in said line of travel and pivotally connected to said linear motion effecting means for displacement therewith along said line of travel, said pivotally displaceable jaw is engageable in camming relationship with said diverting surface of said guide member as said pivotally displaceable is displaced along said line of travel by said linear motion effecting means and means are disposed between said jaws for biasing said pivotally displaceable jaws into engagement with said camming surface of said guide member.

2. An assembly according to claim 1 wherein said linear motion effecting means comprises a cylinder assembly including a cylinder mountable on said component, connectable to a source for providing fluid under pressure selectively to opposite ends thereof, and a piston disposed in said cylinder provided with a rod disposed along said line of travel operatively connected to said linkage.

3. An assembly according to claim 1 wherein said cylinder is mountable on said component to provide linear motion of said rod longitudinally of said component, and said jaw is pivotal about a pin mountable transversely relative to said component, spaced laterally of said line of travel of said rod.

4. An assembly according to claim 1 wherein said linear motion effecting means comprises a rotary actuator mountable on said component, connectable to a power source, provided with a rotatable screw member threaded into a rotationally restrained nut linearly movable along said line of travel.

5. An assembly according to claim 1 wherein said opening through said guide member is provided with a second camming surface opposed to and diverting from said first mentioned camming surface, engaged by said other jaw.

* * * * *